US006499168B1

(12) United States Patent
Anderson

(10) Patent No.: US 6,499,168 B1
(45) **Date of Patent: *Dec. 31, 2002**

(54) DRILL ADAPTER WITH EFFICIENT HIGH ENERGY PERMANENT MAGNETIZER

(76) Inventor: Wayne Anderson, 65 Grove St., Northport, NY (US) 11768

( * ) Notice: Subject to any disclaimer, the term of this patent is extended or adjusted under 35 U.S.C. 154(b) by 0 days.

This patent is subject to a terminal disclaimer.

(21) Appl. No.: 09/504,190

(22) Filed: Feb. 15, 2000

Related U.S. Application Data

(63) Continuation-in-part of application No. 08/690,740, filed on Jul. 31, 1996, now Pat. No. 6,105,474.

(51) Int. Cl.[7] ..... B25B 15/00; B25B 23/08
(52) U.S. Cl. ..... 7/165; 81/451
(58) Field of Search ..... 81/451, 125; 7/165

(56) References Cited

U.S. PATENT DOCUMENTS 2,782,822 A * 2/1957 Clark ..... 81/451
3,392,767 A * 7/1968 Stillwagon, Jr. ..... 81/451

* cited by examiner

*Primary Examiner*—Eileen P. Morgan
*Assistant Examiner*—Joni B. Danganan
(74) *Attorney, Agent, or Firm*—Lackenbach Siegel LLP

(57) ABSTRACT

A drill adapter includes an elongate support holder and a generally elongate member fixed to one axial end of the support holder configured to be secured in a chuck of a drill to rotate the support holder. A reversible bit carrying member supports the drill bit at one end and a driver bit at the other end, and is receivable within the support holder. A magnet, formed of a permanently magnetized material having a high energy product, preferably equal to at least $7.0\times10^6$ gauss-oersteds, which may be in the form of a pill magnet embedded within the support holder or may be in the form of a sleeve of magnetizable material, surrounds at least an axial end portion of the support holder proximate to the end of the support holder that supports the driver bit in its operative position. The driver bit becomes a part of the resulting magnetic circuit of the magnet and at least some of the resulting magnetic field passes through the driver bit to at least partially shunt the magnetic field to magnetize the driver bit, and the adapter can be used to initially drill a pilot hole with the driver bit and thereafter drive a fastener into the pilot hole by means of the driver bit that becomes magnetized as soon as it is inserted into the support holder of the drill adapter.

23 Claims, 5 Drawing Sheets

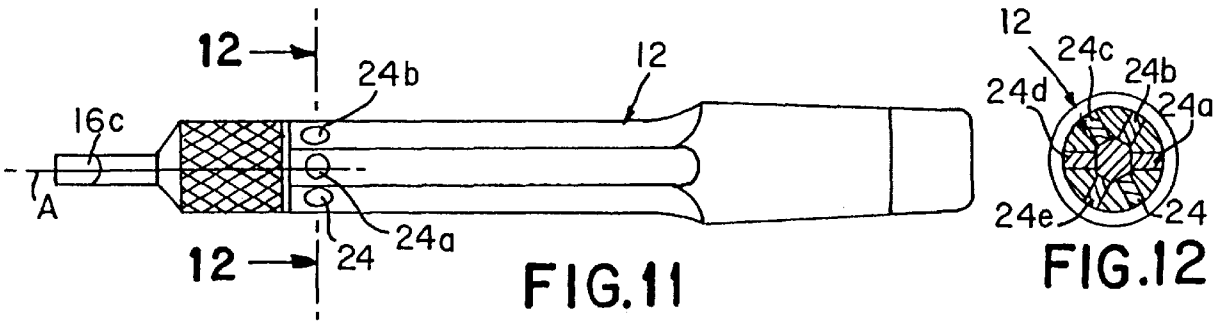
FIG.11
FIG.12
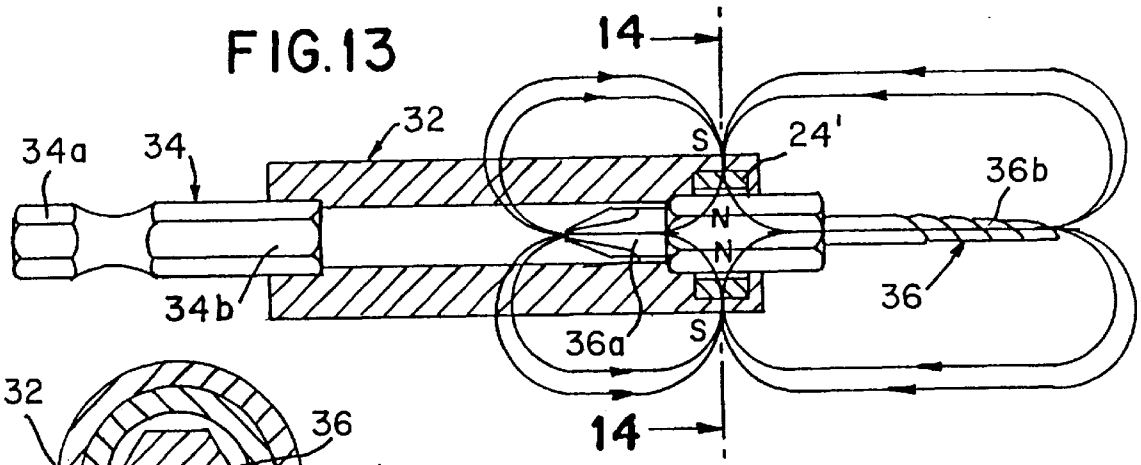
FIG.13
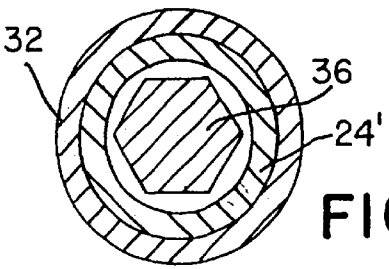
FIG.14

DRILL ADAPTER WITH EFFICIENT HIGH ENERGY PERMANENT MAGNETIZER

CROSS REFERENCE TO RELATED APPLICATION

This application is a continuation-in-part of U.S. patent application Ser. No. 08/690,740 filed on Jul. 31, 1996 (our docket no. P-9) now U.S. Pat. No. 6,105,474.

BACKGROUND OF THE INVENTION

1. Field of the Invention

The present invention generally relates to tools, and, more specifically, to a drill adapter that includes, typically for alternating use, drill and driver bits and that embodies at least one efficient high energy permanent magnet for magnetizing the exposed tips of the screwdriver or other driver bits mounted on the drill adapter.

2. Description of the Prior Art

It is frequently desirable to magnetize the tips of screwdriver bits and the like to form at least temporary magnetic poles on the tips that attract magnetizable elements. Thus, particularly with precision screwdrivers that tend to be relatively small and are used to drive relatively small screws, it is frequently advantageous to magnetize the screwdriver tips of the driver bits to maintain the screwdriver tip blade within the slot of a head of a screw or a Phillips driver within the cross slots formed within the head of the screw adapted to receive the Phillips screwdriver tip. By magnetizing the tip of the driver bit, and mating the tip within the associated opening in the head of the screw, the screw remains attached to the bit tip without the need to hold them together. This allows the screw to be guided through a relatively small bore or channel and moved within confined spaces. Sometimes, the magnetized tip of the driver bit is used to retrieve a metal item, such as a screw, washer, nail or the like, from an inaccessible place that would otherwise be difficult to reach with anything but a relatively thin shank of a bit driver. Of course, such attachment of a fastener to the driver bit tip also frees one hand for holding or positioning the work into which the fastener is to be driven.

Devices for magnetizing/demagnetizing tools and small parts are well known. These normally incorporate one or more permanent magnets that create a sufficiently high magnetic field to magnetic at least a portion of a magnetizable element brought into its field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Most bit drivers are made of magnetically soft materials that are not normally magnetized. In order for such bit drivers to exhibit magnetic poles they must be placed in a magnetic field. Hard materials are used to supply fixed fields either to act alone, as in a magnetic separator, or interact with others, as in loudspeakers and instruments.

Most magnetizers/demagnetizers include commercial magnets that are formed of either Alnico or are of the ceramic type. The driver members, on the other hand, are normally made of soft materials that are readily magnetized but more easily lose their magnetization, such as by being drawn over an iron or steel surface, subjected to a demagnetizing influence, such as heavy magnetic fields or other permanent magnetic fields, severe mechanical shock or extreme temperature variations.

One example of a magnetizer/demagnetizer is magnetizer/demagnetizer Model No. 40010, made in Germany by Wiha. This unit is in the form of a box made from plastic and forms two spaced openings defined by three spaced transverse portions. Magnets are placed within one of the transverse portions to provide magnetic fields, in each of the two openings that are directed in substantially opposing directions. Therefore, when a magnetizable tool bit or any magnetizable component is placed within one of the openings, it becomes magnetized, and when placed in the other of the openings, it becomes demagnetized. The demagnetizing window is provided with progressive steps to decrease the air gap for the demagnetizing field and, therefore, provides different levels of strengths of the demagnetizing field. However, typical magnetic materials that are used with conventional magnetizers/demagnetizers include Alnico and ceramic magnets that typically have energy products equal to approximately $4.5\times10^6$ gauss-oersteds and $2.2\times10^6$ gauss-oersteds, respectively.

Since the field strength B at the pole of the magnet is a product of the unit field strength and the area, and since the force of the magnet (H) is the product of the unit force (are the same unit field strengths) and the length of the magnet, it follows that the energy content or BH product is proportional to the volume of the magnet. It is for this reason that conventional magnetizers/demagnetizers have required bulky magnets having significant volumes to provide the desired energy content suitable for magnetizing and demagnetizing parts. However, the required volumes have rendered it impossible or impractical to incorporate the magnetizers/demagnetizers on the tools in conjunction with which they are frequently used. Thus, for example, precision screwdrivers, which are relatively small and have relatively small diameter handles could not possibly incorporate sufficient magnetic material to provide desired or required levels of magnetic fields for magnetizing and demagnetizing parts. However, the requirement of using separate magnetizer/demagnetizer units has rendered their use less practical. Thus, unless a user of a precision screwdriver or any driver tool obtained a separate magnetizer/demagnetizer, one would not normally be available for use. Additionally, even if such magnetizer/demagnetizer were available, it would require a separate component that could be misplaced and not available when needed. Of course, there is always the risk that the magnetizer/demagnetizer could become misplaced or lost, rendering the driver tool less useful.

A well known design of a magnetizable driver tool 10 is illustrated in FIG. 1, in which the handle 12 is provided with central axial channel 14, which receives a portion 16*a* of a driver bit, leaving an external portion 16*b* exposed that has, at its free end, an operating tip 16*c* for driving, for example, a fastener. Another operative tip 16*d* is typically provided at the other end of the bit driver 16 which may be the same as or different than the operative tip 16*c*. In FIG. 1, the operative tip 16*c* is a screwdriver tip while the operative 16*d* is a Phillips driver. A chuck 18 may be used to selectively remove the bit driver 16 and reverse its direction to allow use of either one of the two operative tips or to replace the driver with another driver bit. In an effort to magnetize the bit driver 16, and, more specifically, to provide a pole at the operative tip 16*c* that can attract a magnetizable fastener, there has typically been provided an in-line permanent magnet 20 arranged along the axis A of the tool with poles at 20*a* and 20*b* as shown. Such a magnet 20 gives rise to a magnetic field of the type illustrated and designated by the reference numeral 22. However, as will be seen, such field 22 only partially interacts with the bit driver 16, and primarily that portion of the driver 16*d* closest to the magnet 20. Such magnetic field does not create a very strong magnetic pole at the operative tip 16*c*. In order to increase the strength of the pole, the size of the magnet 20 has been increased in order to enhance the magnetic field 22. However, this rendered the magnet 20 relatively large in relation to the size of the handle 12 and significantly increased the weight of the tool. Even so, the degree of magnetic field coupling to the bit driver 16, particularly to the exposed operative tip 16*c*, has remained low and thus the strength of the magnetic pole created at that end has remained relatively small.

Similar problems arise in conjunction with drill adapters, which are designed to be secured within a chuck of a drill and include, typically for alternating use, a drill bit and a driver bit, such as a flat blade or Phillips screwdriver bit. Typically, the drill adapter is secured within the chuck of the drill with the drill bit mounted for initial use for drilling a pilot hole within the surface of the work into which a fastener is to be inserted. Once the hole has been drilled, the drill and bit drivers are reversed, so that the driver bit can be quickly and conveniently changed so that the drill bit is moved to an inoperative position while the screwdriver bit, or any other driver bit, can be moved to the operative fastener driving position where it can drive the fastener into the previously drilled pilot hole. However, it is frequently desirable to initially secure and accurately position the fastener to align it with the pilot hole before it is driven into the work.

SUMMARY OF THE INVENTION

Accordingly, it is an object of the present invention to provide a drill adapter that magnetizes a tool driver made of soft magnetic material, such as a driver bit, that does not have the disadvantages inherent in the prior art.

It is another object of the present invention to provide a drill adapter with an efficient high energy, permanent magnetizer on the support holder, which is simple in construction and economical to manufacture.

It is still another object of the present invention to provide a drill adapter of the type suggested that provides a strong and effective pole at the exposed end of the bit driver by providing enhanced coupling between the permanent magnet and the bit driver.

It is yet another object of the present invention to provide a drill adapter as in the previous objects that is lightweight and less bulky than such prior art drill adapters.

It is a further object of the present invention to provide a drill adapter that can variably provide a magnetic pole at the exposed driver tip that can be made stronger or weaker depending on the application.

It is still a further object of the present invention to provide a drill adapter as described in the previous objects that does not require bulky magnets and, therefore, in which the adapter can be easily used to drill pilot holes and countersinks and thereafter drive a fastener into the pilot hole by means of a driver bit that becomes magnetized as soon as inserted into the drill adapter.

In order to achieve the above objects, as well as others that will become apparent hereafter, a drill adapter in accordance with the present invention comprises a generally elongate support holder that defines a holder axis and first and second axial ends. A generally elongate member is provided that is fixed to one axial end of said support holder and arranged to be generally aligned and coextensive with said holder axis, and dimensioned and configured to be secured with the chuck of a drill to transmit torque supplied to said first elongate member by the drill to said support holder to cause common rotation about said holder axis. Said support holder has an axial opening at said second axial end coextensive with said holder axis. A reversible bit carrying member is provided that generally defines a driver axis and opposing first and second bit supporting axial ends extending in opposite directions along said driver axis and has an intermediate mating portion removably receivable within said axial opening of said support holder. A drill bit extends in one direction along said driver axis from one bit supporting axial end and a driver bit is extendable in an opposing direction along said driver axis. Said intermediate mating portion is removably receivable within said axial opening once said holder and driver axes are substantially aligned. Said support holder is provided with an internal axial space extending from said axial opening to receive one of said bits in an inoperative position within said internal axial space when said other of said bits extends in an operative position beyond said axial opening along said axes. Magnet means is mounted at said second axial end to be in proximity with said bit carrying member in defining a magnetic axis that is substantially normal to said holder axis, whereby the adapter can be easily used to drill pilot holes with said drill bit and thereafter drive a fastener into a pilot hole by means of said driver bit that becomes magnetized as soon as it is inserted into said suport holder of the drill adapter.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which:

FIG. 11 is a side elevational view of yet a further embodiment of the present invention in which a plurality of permanent magnets are embedded within the tool handle about the bit receiving channel, the number of such magnets used in this embodiment being six;

FIG. 12 is a cross sectional view of the tool shown in FIG. 11, taken along line 12—12;

FIG. 13 illustrates the use of the present invention on a drill adapter including a bit receiving holder, other than a conventional handle, in which the permanent magnet is in the form of an annulus similar to the embodiment shown in FIGS. 7 and 8 that surrounds the driver bit in its normal operating position;

FIG. 14 is a cross sectional view of the device shown in FIG. 13, taken along line 14—14;

FIG. 19 is a perspective view of a reversible bit carrying member designed to be used with a drill adapter in accordance with the present invention;

FIG. 20 is a cross sectional view of the reversible bit carrying member shown in FIG. 19;

FIGS. 21*a*–21*c* are cross sectional views of the reversible bit carrying member shown in FIG. 20, respectively taken along lines 21*a*—21*a*, 21*b*—21*b* and 21*c*—21*c*;

FIG. 22 is a cross sectional view of a drill adapter in accordance with the invention incorporating the reversible bit carrying member shown in FIGS. 19 and 20 with a drill received internally and in an inoperative position and a driver bit extending exteriorly in an operative position;

FIG. 23 is similar to FIG. 22, but with a reversible bit carrying member reversed to place the drill bit in the operative position and the driver bit internally in an inoperative position;

FIG. 24 is an exploded view of the drill adapter shown in FIGS. 22 and 23, showing the reversible bit carrying member partially withdrawn from the drill adapter and the driver bit partially withdrawn from the reversible bit carrying member;

FIG. 25 is similar to FIG. 24, but with the reversible bit carrying member reversed in a condition to position the drill bit in an operative position; and FIG. 26 is a reversible bit carrying member similar to the one shown in FIG. 19, but provided with cutting edges on the tapered portion proximate to the drill bit for drilling a countersink in a surface through which a pilot hole has been drilled.

DESCRIPTION OF THE PREFERRED EMBODIMENT

Figure 1:
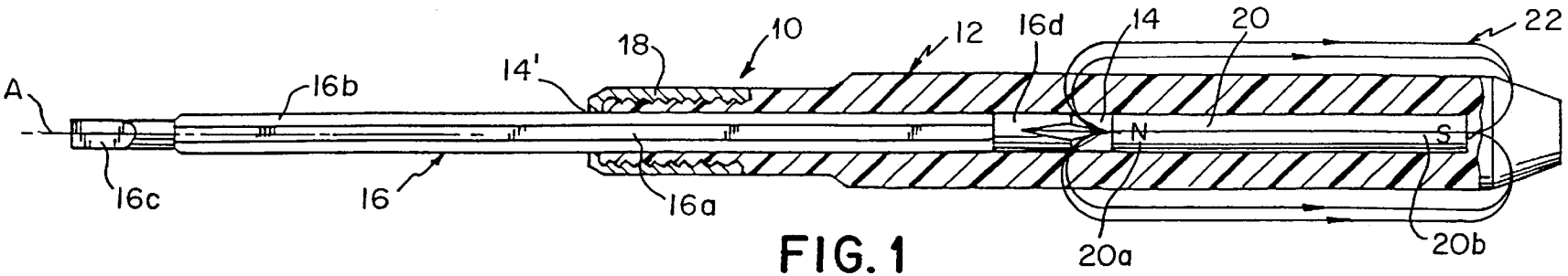
FIG. 1 PRIOR ART
FIG. 1 is a side elevational view, partially in longitudinal cross section, of a driver tool with a permanent magnet on the tool handle to magnetize the driver tip in accordance with the prior art.
Figure 2:
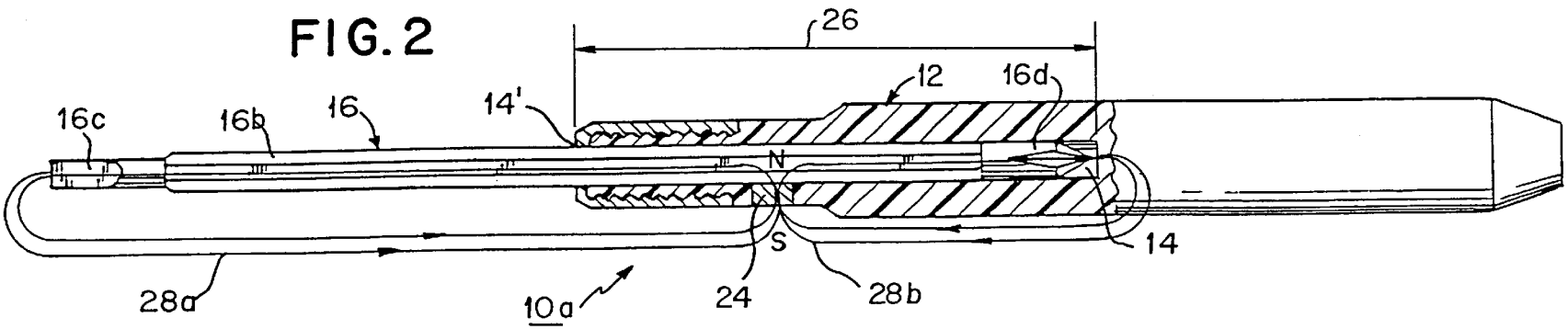
FIG. 2 is similar to FIG. 1, but showing one embodiment of the present invention in which a high energy permanent magnet is efficient located on the tool handle on the side of the driver bit within the receiving zone for receiving a portion of the bit driver.
Figure 3:
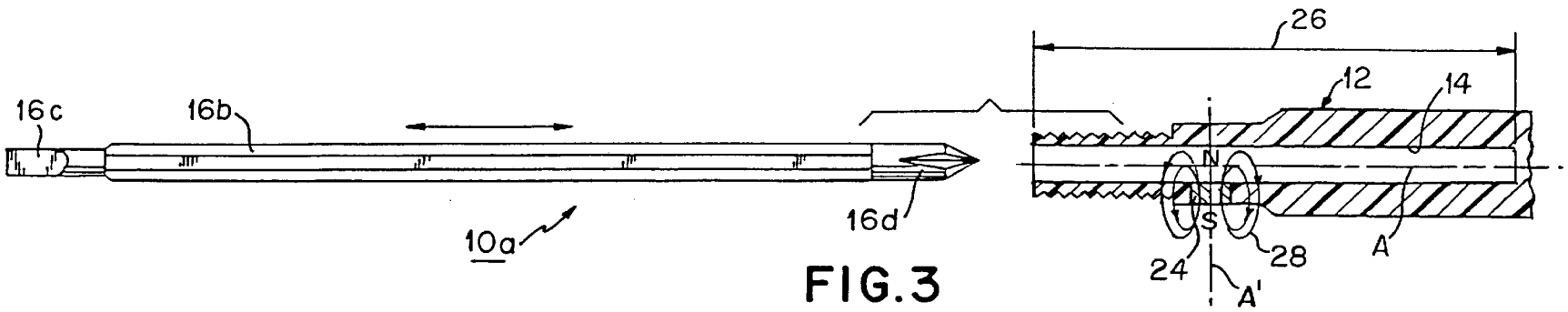
FIG. 3 is an exploded view of the embodiment shown in FIG. 2, illustrating the bit driver removed from the channel defining the bit driver receiving zone and the action of the permanent magnet creating a magnetic field within the channel.

Referring now specifically to the figures, in which identical or similar parts are designated by the same reference numerals throughout, and first referring to FIGS. 2 and 3, a driver tool 10*a* is illustrated which is generally similar to the prior art tool 10 illustrated in FIG. 1. However, the tool 10*a* does not require a bulky magnet of the type illustrated by the reference numeral 20 in FIG. 1 and which occupies a substantial portion of the volume of the tool handle. Instead, the present invention contemplates the use of one or more relatively small, high energy product permanent magnets embedded on the side of a handle 12 in a region proximate to the bit 16 when same is inserted into the handle during normal use as illustrated in FIG. 2. More specifically, the elongate channel 14 is adapted to longitudinally receive a predetermined length portion of the bit driver, the handle defining a receiving zone 26 which extends from the open end 14' of the channel 14 and has an axial length at least equal to the predetermined length of the bit driver to be received within the handle. As illustrated in FIG. 3, the magnet 24 is arranged along the receiving zone 26 in close proximity to the channel 14 for generating a magnetic field 28 defining a magnetic axis A' which is substantially normal to the handle axis A.

The magnetic field 28 extends into the channel 14, so that when the driver bit 16 is fully inserted into the channel 14, the bit driver becomes part of the magnetic circuit of the magnet 24 to at least partially shunt the air space for the magnetic field.

Figure 4:
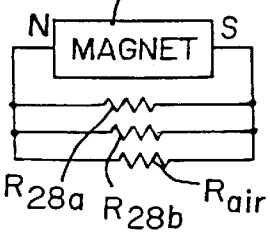
FIG. 4 is a schematic diagram illustrating the equivalent magnetic circuit for the embodiment illustrated in FIG. 2.

Referring to FIG. 4, the magnet 24 generates a magnetic field 28 in the configuration illustrated in FIG. 3, prior to insertion of the driver bit. This configuration, with air initially occupying the space within the channel 14 presents a generally high reluctance to the magnetic field, this being represented by $R_{air}$. However, as illustrated in FIG. 2, once the driver bit 16 is inserted into the channel 14, the magnetic fields 28*a*, 28*b* now has alternate, parallel paths within which to pass, namely the magnetic material of which the driver bit is made. A modified magnetic filed (not shown) continues to exist representing modified $R_{air}$. In FIG. 4, the reluctances represented by the driver bit portion is designated $R_{28a}$, $R_{28b}$. It is clear from the circuit in FIG. 4, that if reluctance of the bit portion is substantially less than the reluctance of the air, which it always is, a considerable part of the flux will pass through the driver bit and significantly bypass the air path. As best illustrated in FIG. 2, the magnetic field will re-distribute itself and some of that field will pass through the operative tip 16*c* to thereby magnetize the same. As will also be evidenced from FIG. 4, the greater the strength of the magnet 24 and the less the value of the bit reluctances, the greater will be the amount of field that passes through the driver bit and the stronger the pole formed at the exposed operative tip 16*c*. Therefore, aside from increasing the energy product of the magnet 24, the desired effect can be enhanced by movement of the magnet 24 forward as much as possible in the direction of the opening 14' of the channel 14 or the front end of the tool handle. The reason for this is that the reluctance of the bit is really a function of the two parallel paths 28*a*, 28*b* within the driver bit itself, the first reluctance $R_{28a}$ being represented by that portion of the bit positioned to one side of the magnet 24 and the other reluctance $R_{28b}$ being represented by that portion of the bit to the other side of the magnet. The further that the magnet is moved towards the front of the tool, the greater will be the useful coupling of the field through the front portion of the bit where the pole is desirably formed. The positioning of the permanent magnet 24, in accordance with the invention, therefore, is such so as to place the magnet in a way that the driver bit effectively couples to the magnetic filed and becomes an active element in the magnetic circuit of the magnet 24 to substantially shunt the field to ensure that at least some but preferably a substantial amount of flux is passed through the exposed operative tip 16*c*.

As indicated, one of the important factors in determining the strength of the pole formed at the exposed operative tip 16*c* is the strength of the magnet 24 itself. As will be appreciated from FIGS. 2 and 3, however, the amount of space available for the magnet in the wall on the side of the handle 12 proximate to the channel 14 is quite small. The magnet 24 must, therefore, be in the form of a relatively thin magnet. However, in order to produce the levels of magnetization desired and in order to form effective poles on the driver tips, one of the features of the present invention is the use of magnets having high magnetic energy products.

Numerous arrangements of magnets may be used to provide enhanced magnetizing fields on conventional handles of driver tools. While this is made possible by the use of permanent magnets which have energy products BH equal to at least $7.0\times10^6$ gauss-oersteds, it is preferred that the magnetic materials used be formed of magnetic materials which have energy products equal to at least approximately $9\times10^6$ gauss-oersteds. Such levels of energy products are obtainable with the classes of materials generally known as neodymium iron boron and cobalt are earth permanent magnets. Such materials are available, for example, from Polymag, Inc. of Bellport, N.Y. and sold under style designations PM70, Poly 10, NDFB30H, NDFB35, NDFB27; and from Hitachi Magnetics Corporation, Division of Hitachi Metals International, Ltd. under the style designations Hicorex 90A, 90B, 96A, 96B, 99A and 99B.

Although the magnet 24 in the first embodiment shown in FIGS. 2 and 3 is in the form of a thin pill or disk magnet consistent with the thickness of the wall forming the handle proximate to the channel 14, other arrangements are possible and contemplated by the present invention. For Example, in FIGS. 5 and 6, an alternate embodiment 10*b* is illustrated in which the magnet 24 of the first embodiment is augmented by an annular sleeve 30 formed of magnetizable material but not being a permanent magnet itself. The magnet 24 is shown to be in contact, at its outer pole face, with the sleeve 30 so as to eliminate any air gap and, therefore, minimize the reluctance and enhance the amount of coupling of the field through the sleeve. Since the sleeve extends axially forwardly in the direction of the exposed part 16*b* of the driver bit, this will have the effect of still further reducing the reluctance $R_{28a}$ associated for that portion of the bit driver to the left of the magnet, as viewed in FIG. 5. This will, for reasons indicated, increase the amount of flux which passes through the operative tip 16*c* and, therefore, this will strengthen the pole at that tip.

Figure 5:
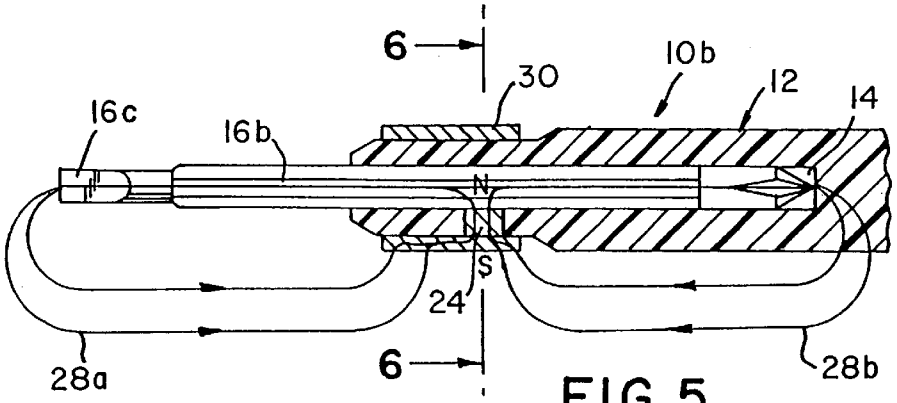
FIG. 5 is similar to FIG. 2 but showing another embodiment in which there is further provided a magnetizable sleeve surrounding the permanent magnet.
Figure 6:
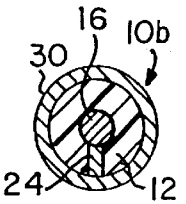
FIG. 6 is a cross sectional view of the tool shown in FIG. 5, taken along lines 6—6.
Figure 7:
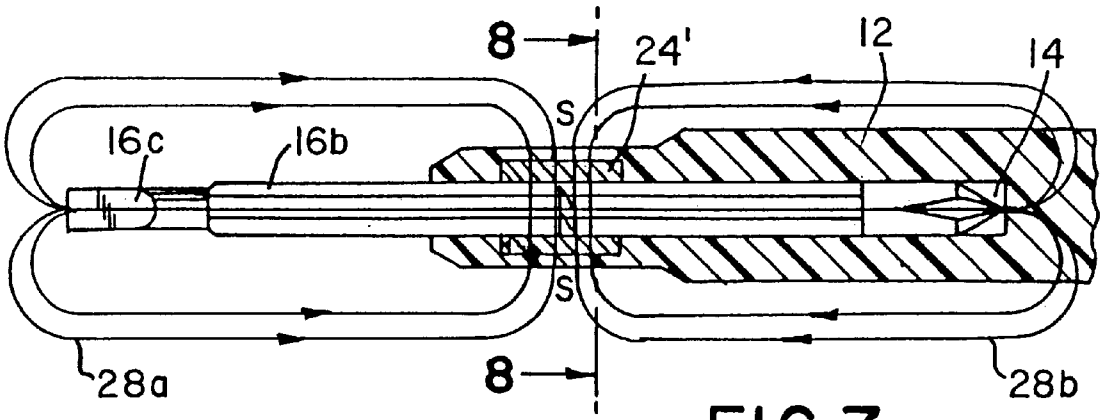
FIG. 7 is a view similar to that shown in FIG. 5, but illustrating a further embodiment in which the permanent magnet is in the form of an annular sleeve embedded within the handle as shown so as to encircle the bit driver during normal use.
Figure 8:
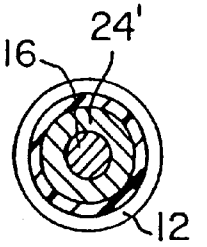
FIG. 8 is a cross sectional of the tool shown in FIG. 7, taken along lines 8—8.

In FIGS. 7 and 8, much of the benefit of the sleeve 30 of FIGS. 5 and 6 is obtained by using a modified magnet 24' in the form of an annular sleeve having a relatively thin wall, as shown, so that it can be embedded within the tool handle. This magnetic sleeve 24*a*, although it may render it more difficult to assemble the tool, normally provides a greater volume of permanent magnetic material, thereby increasing the strength of the field and the amount of the field coupled to the exposed operative tip 16*c*.

Figure 9:
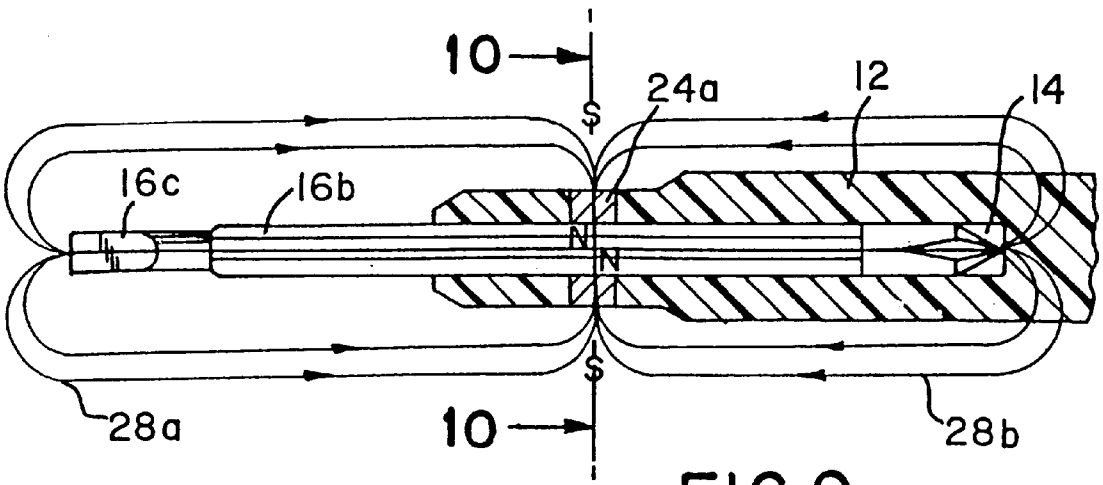
FIG. 9 is a view similar to that shown in FIG. 2, but illustrating another embodiment in which two permanent magnets are provided on diametrically opposite sides of the bit driver receiving channel.
Figure 10:
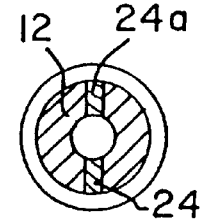
FIG. 10 is a cross sectional view of the tool shown in FIG. 9, taken along lines 10—10.

In FIGS. 9 and 10, two disks or pill magnets 24, 24*a* of the type shown in FIGS. 2 and 3 are used to double the strength of the magnetic field, the two magnets being positioned on diametrically opposite sides of the channel 14 to ensure that the fields produced by each of the magnets similarly couples to the driver bit.

In FIGS. 11 and 12, the arrangement of FIGS. 9 and 10 is extended by providing six permanent magnets 24, 24*a*, 24*b*, 24*c*, 24*d*, 24*e* substantially equally angularly spaced from each other about the tool axis A and on opposite sides of the driver bit or receiving channel 14. In theory, assuming that all of the pill or disk magnets are the same size, the strength of the pole formed at the operative driver tip 16*c* with the embodiment shown in FIGS. 11 and 12 should be approximately six times that of the arrangements shown in FIGS. 2 and 3 and three times the strength of the arrangement shown in FIGS. 9 and 10, barring saturation problems.

A drill adapter incorporating the present invention is shown in FIGS. 13 and 14. It includes a generally elongate support holder 32 defining a holder axis $A_d$ and first and second axial ends 32*a*, 32*b*. A generally elongate member 34 is fixed to the axial end 32*a* of the support holder and arranged to be generally aligned and coextensive with the holder axis $A_d$ and dimensioned and configured to be secured at the end 34*a* in a chuck of a drill to transmit torque supplied to the member 34 by the drill to the support holder 32 to cause common rotation of the holder 32 and member 34 about the holder axis. The support holder 32 has an axial opening 32*c* at the axial end opposite to where the elongate member 34 is mounted and an internal space 32*d* extending at least partially inwardly from the opening 32*c*, for reasons to be described.

A reversible bit carrying member 36 generally defines a driver axis and opposing first and second bit supporting axial ends extending in opposite directions along a driver axis, and it has an intermediate mating portion 36' which is removably receivable and supportable within the axial opening 32*c* of the support holder 32. A drill bit 36*b* extends in one direction along the driver axis from one bit supporting axial end of the member 36, and a driver bit 36*a* extends in an opposing direction along the driver axis. The intermediate mating portion 36 is removably receivable within the axial opening 32*c* when the holder and driver axes are substantially coextensive. The internal cavity or space 32*d* with the support holder 32 extends from the axial opening 32*c* to selectively receive one of the bits 36*a*, 36*b* within the internal axial space 32*d* when the other of the bits extends to an operative position beyond the axial opening 32*c* along the axes. A sleeve magnet 24' is mounted at the second axial end at the axial opening 32*c* to be in proximity with the reversible bit carrying member 36, as shown, embedded within the wall of the support holder 32. It is clear that the sleeve magnet 24' will produce a magnetic field similar to that shown in FIGS. 7 and 8 when used in conjunction with a tool handle and will place the reversible bit carrying member 36 within the magnetic circuit to magnetize the two opposing axial ends of the member 36. While the magnetization of the drill bit 36*b* does not serve any real purpose, it is clear that the magnetization of the driver bit 36*a* will facilitate the retention and driving of a fastener, such as a screw, when the drill bit adapter is used to drive the fastener with the driver bit 36*a*. This would, of course, require a reversal of the reversible bit carrying member 36, as to be more fully discussed below.

As with the tool handle, the drill adapter 32 causes the reversible bit carrying member, and the bits mounted thereon, to at least partially shun the magnetic field and magnetize the exposed driver tip of the driver bit.

As should be clear, the adapter shown in FIGS. 13 and 14 can be easily used to initially drill pilot holes with the drill bit 36*b* and thereafter drive a fastener (not shown) into a pilot hole by means of a driver bit 36*a*, by reversing the member 36 that becomes magnetized as soon as inserted into the drill adapter.

The drill adapters in FIGS. 15–18 are similar to the one shown in FIGS. 13 and 14, with the exception of the specific magnet configurations mounted on the support holder 32. Thus, in FIGS. 15 and 16, an annular sleeve 30' is in contact with one polar face with a pill or disk magnet 24, but which itself is not a permanent magnet but formed of a magnetizable material. Therefore, the embodiment illustrated in FIGS. 15 and 16 generally corresponds to that illustrated in FIGS. 5 and 6. Similarly, the use of a single magnet can also be used in connection with the tubular support holder of the type shown in FIGS. 17 and 18, which corresponds to the tool embodiment shown in FIGS. 2 and 3.

In FIGS. 13–18, the support holder 32 is in the form of a tubular member having two axial open ends, one of which forms the second axial end 32*c* configured to removably receive the intermediate mating portion 36', and the other end of which is securely fixed to the elongate member 34. In these embodiments, the tubular member is continuously hollow between the two axial open ends. The specific manner of attaching the end 34*b* of the elongate member 34 to the end 32*a* of the support holder is not critical, and any suitable or conventional way can be used to effect such attachment. Preferably, the end 34*a* of the elongate member 34 is formed with a hexagonal cross section to facilitate insertion into and gripping by a chuck of a drill.

The internal surface of the axial opening 32*c* and the exterior surface of the intermediate mating portion 36' are dimensioned and configured to mate when the reversible bit carrying member 36 is inserted into the support holder 32. Any known or conventional means may be used to selectively retain the reversible bit carrying member within the support holder such as, for example, a detent and spring loaded bearing (not shown). In the embodiment illustrated, both of these mating surfaces have mating hexagonal cross sections.

In the embodiments illustrated in FIGS. 13–18, the drill bit 36*b* and the driver bit 36*a* are integrally formed with the intermediate mating portion 36'.

Referring to FIGS. 19 and 20, another embodiment of a reversible bit carrying member is shown and generally designated by the reference numeral 40. The reversible bit carrying member 40 is configured to be receivable within a modified support holder 32', shown in FIGS. 22–25. The support holder 32' may be formed from a solid rod machined to provide bores 42*a*–42*d* having different cross sectional configurations to receive various portions of the reversible bit carrying member 40 in either one of the two reversed positions. Thus, the initial region 42*a* proximate to the axial opening 32*c* is shown to be provided with internal flat faceted surfaces 40' forming a hexagonal cross section for matingly receiving the exterior hexagonal shaped intermediate mating portion 44*a*. Within the reversible bit carrying member 40, moving inwardly, the next succeeding internal region 42*b* has an internal circular cylindrical configuration for receiving the generally circular cylindrical region 44*b* in which a transverse threaded bore 44*d* is formed for receiving a set screw 50 for securing the drill bit 36*b*, as shown. The end of the reversible bit carrying member 40 is advantageously provided with a conical region 44*c* which, as shown in FIGS. 19 and 26, may be provided with fluted cutting edges at the transitional point with the drill bit 36*b* so that when a drilling operation is performed, with the drill bit as shown in FIG. 23, the surface in which a pilot hole is drilled may at the same time be provided with a countersink or counterbore.

Figure 15:
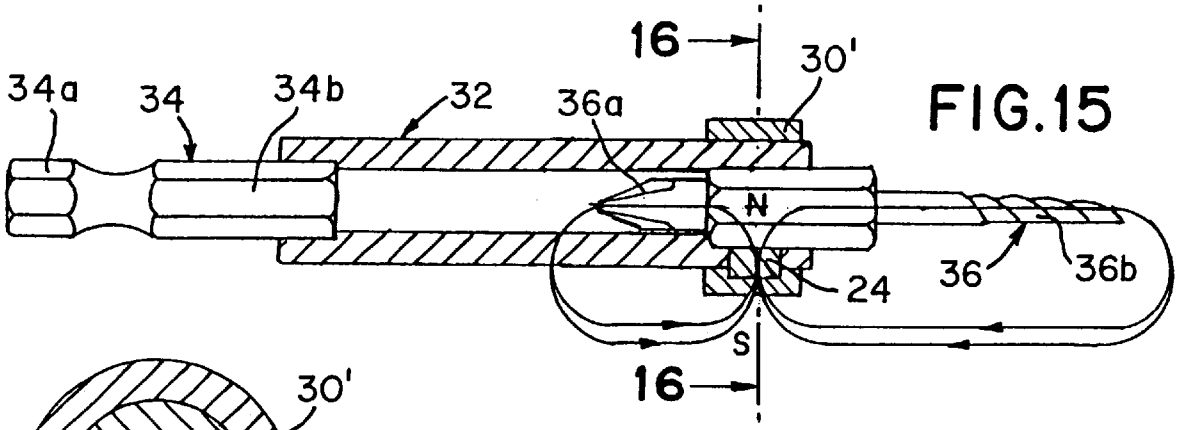
FIG. 15 is similar to FIG. 13, except that a disk or pill magnet is used in combination with a magnetizable sleeve that is placed on the magnetic circuit of the permanent magnet.
Figure 16:
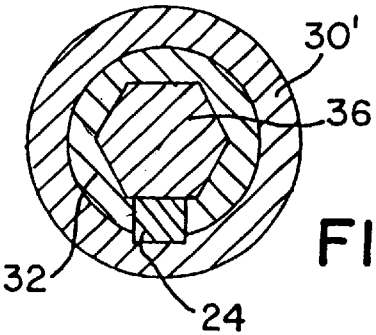
FIG. 16 is a cross sectional view of the device shown in FIG. 15, taken along line 16—16.
Figure 17:
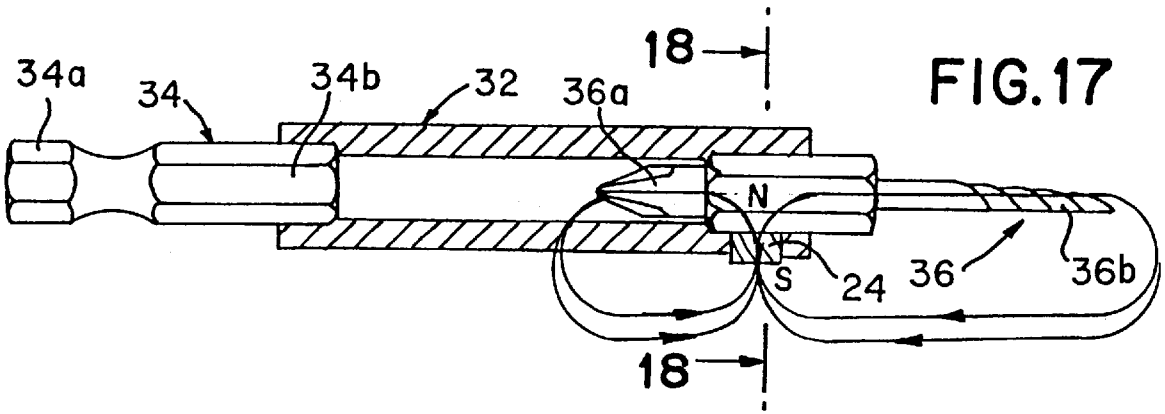
FIG. 17 is similar to FIG. 15, except that no annular sleeve is used.
Figure 18:
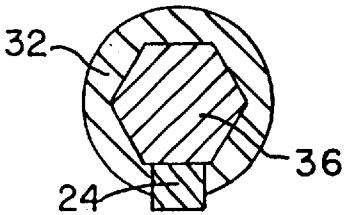
FIG. 18 is a cross sectional view of the device shown in FIG. 17, taken along line 18—18.

The construction of the reversible bit carrying member 40, shown in FIGS. 19–26, is more flexible and less costly to manufacture than the corresponding member 36 shown in FIGS. 13, 15 and 17. When made as a unitary construction, the reversible bit carrying member 36 provides a single driver bit 36*a* and a single drill bit 36*b*, requiring a plurality of such reversible bit carrying members to allow for differently sized pilot holes and different fastener sizes. Also, the reversible bit carrying member 36 is more difficult to manufacture, requiring special machining functions. In contrast, the reversible bit carrying member 40 uses conventional drill bits 36*b* and a range of different sizes may be accommodated within the same member 40. Also, by mounting the driver bits within a cavity 44*e* forming a sleeve within the region 44*a*, a dual back-to-back driver bit of the type shown can be used to accommodate two differently sized fasteners. Removal of the dual driver bit results in the hexagonal cavity 44*e*, which can also be used to drive hex shaped screw heads, thus providing a three-in-one driver arrangement. Therefore, while the driver bit 36*a* is fixedly or rigidly formed with the intermediate mating portion 36', it is removably mounted on the reversible bit carrying member 40 by any suitable or conventional attachment means. The same is true, as noted, for the drill bit, which may be secured by the set screw 50 while a spring loaded bearing and detent arrangement, including bearing 46*d*, may be used for removably retaining the drill bit.

In FIG. 26 a removable bit carrying member 40' is shown similar to the member 40 in FIG. 19. However, a modified tape configuration 44*c'* is shown which has a greater number of cutting edges. It will be evident that the region 44*c* can be configured to provide any desired shape for a countersink or counterbore.

While this invention has been described in detail with particular reference to a preference embodiment thereof, it will be understood that variations and modifications will be effected within the spirit and scope of the invention as described herein and as defined in the appended claims.

What I claim is:

1. A drill adapter comprising a generally elongate support holder defining a holder axis and first and second axial ends;

a generally elongate member fixed to one axial end of said support holder and arranged to be generally aligned and coextensive with said holder axis and dimensioned and configured to be secured with the chuck of a drill to transmit torques applied to said first elongate member by the drill to said support holder to cause common rotation about said holder axis, said support holder having an axial opening at said second axial end coextensive with said holder axis;

a reversible bit carrying member generally defining a driver axis and opposing first and second bit supporting axial ends extending in opposite directions along said driver axis and having an intermediate mating portion removably receivable within said axial opening of said support holder, a drill bit extending in one direction along said driver axis from one bit supporting axial end and a driver bit extending in an opposing direction along said driver axis, said intermediate mating portion being removably receivable within said axial opening when said holder and driver axes are substantially aligned, said support holder being provided with an internal axial space extending from said axial opening to receive one of said bits in an inoperative position within said internal axial space when said other of said bits extends in an operative position beyond said axial opening along said axes; and magnet means mounted at said second axial end to be in proximity with said bit carrying member and defining a magnetic axes which is substantially normal to said holder axis, whereby said driver bit becomes part of the resulting magnetic circuit of said magnetic means and at least some of the resulting magnetic field passes through said driver bit to at least partially shunt the magnetic field to magnetize said driver bit and whereby the adapter can be used to initially drill a pilot hole with said drill bit and thereafter drive a fastener into the pilot hole by means of said driver bit that becomes magnetized as soon as it is inserted into said support holder of the drill adapter.

2. A drill adapter as defined in claim 1, wherein a support holder comprises a tubular member having two axial open ends one of which comprises said second axial end dimensioned and configured to removably receive said intermediate mating portion and the other end of which securely receives said generally elongate member.

3. A drill adapter as defined in claim 2, wherein said tubular member is hollow between said two axial open ends.

4. A drill adapter as defined in claim 1, wherein said elongate member has a free end formed with a hexagonal cross section for facilitating being gripped by a chuck.

5. A drill adapter as defined in claim 1, wherein said reversible bit carrying member intermediate mating portion and said second axial end have mating cross sections.

6. A drill adapter as defined in claim 5, wherein said cross sections are hexagonal.

7. A drill adapter as defined in claim 1, wherein said drill bit and driver bit are integrally formed with said intermediate mating portion.

8. A drill adapter as defined in claim 1, wherein said drill bit is removably mounted on said reversible bit carrying member by attachment means.

9. A drill adapter as defined in claim 8, wherein said attachment means comprises a coaxial bore at said one bit supporting axial end and a set screw for removably retaining said drill bit within said coaxial base.

10. A drill adapter as defined in claim 1, wherein said intermediate mating portion has a diameter greater than that of said drill bit, said intermediate mating portion being further formed with tapered cutting elements at the axial region where said drill bit connects to said intermediate mating portion to form a countersink drill.

11. A drill adapter as defined in claim 1, wherein said driver bit supporting portion comprises a sleeve for removably receiving a driver bit.

12. A drill adapter as defined in claim 11, wherein said driver bit comprises a two ended driver having different bit portions at opposite ends, said two ended driver being receivable within said sleeve.

13. A drill adapter as defined in claim 1, wherein said magnet means is formed of a permanently magnetized material having an energy product equal to at least $7.0\times10^6$ gauss-oersteds.

14. A drill adapter as defined in claim 1, wherein said magnet means is embedded within said support holder.

15. A drill adapter as defined in claim 13, wherein said magnet means is in the form of a pill magnet.

16. A drill adapter as defined in claim 1, wherein said magnet means is formed of neodymium iron boron permanent magnetic material.

17. A drill adapter as defined in claim 1, wherein said magnet means is formed of cobalt rare earth permanent magnetic material.

18. A drill adapter as defined in claim 1, wherein said magnet measure comprises a pill magnet embedded within said support holder with one polar surface generally facing radially inwardly in the direction of said holder axis and the other of the polar surfaces generally facing radially outwardly away from said holder axis.

19. A drill adapter as defined in claim 18, further comprising a sleeve of magnetizable material surrounding at least an axial length portion of said support holder on which said magnet means is provided, said sleeve being proximate to said other polar surface of said magnet means.

20. A drill adapter as defined in claim 1, wherein said magnet means comprises a permanent magnet in the form of an annular ring embedded within said support holder.

21. A drill adapter comprising;

a generally elongate support holder defining a holder axis and first and second axial ends;

a generally elongate member fixed to one axial end of said support holder and arranged to be generally aligned and coextensive with said holder axis and dimensioned and configured to be secured with the chuck of a drill to transmit torque applied to said elongate member by the drill to said support holder to cause rotation about said holder axis;

said support holder having an axial opening at said second axial end;

a tool bit being removably receivable within said second end axial opening; and magnet means mounted at said second axial end to be in proximity with said tool bit and defining a magnetic axis which is substantially normal to said holder axis, whereby said tool bit becomes part of the resulting magnetic circuit of said magnet means and at least some of the resulting magnetic field passes through said tool bit to at least partially shunt the magnetic field to magnetize said tool bit.

22. A drill adapter as defined in claim 21, wherein the support holder comprises a tubular member having an axial opening at said first axial end which securely receives said generally elongate member.

23. The drill adaptor of claim 21, said magnet means having an energy product of at least $7.0\times10^6$ gauss-oersteds.

* * * * *